US005813673A

United States Patent [19]

Richardson

[11] Patent Number: 5,813,673

[45] Date of Patent: Sep. 29, 1998

[54] METHOD OF PLAYING A CARD GAME

[76] Inventor: Ronald Richardson, 2011 Shenandoah St., Los Angeles, Calif. 90034

[21] Appl. No.: 819,775

[22] Filed: Mar. 18, 1997

[51] Int. Cl.[6] ..... A63F 1/00

[52] U.S. Cl. ..... 273/292; 273/274

[58] Field of Search ..... 273/292, 274, 273/303–306

[56] References Cited

U.S. PATENT DOCUMENTS

| | | | |
|---|---|---|---|
| 5,154,429 | 10/1992 | LeVasseur | 273/292 |
| 5,320,356 | 6/1994 | Cauda | 273/292 |
| 5,324,041 | 6/1994 | Boylan | 273/292 |
| 5,407,209 | 4/1995 | Prerost | 273/292 |
| 5,417,430 | 5/1995 | Breeding | 273/292 |
| 5,607,162 | 3/1997 | Boylan et al. | 273/292 |

OTHER PUBLICATIONS

"Monte Bank", Hoyle's Modern Encyclopedia Of Card Games, Walter Gibson, Doubleday & Company, Inc, p. 162, Copyright 1974.

*Primary Examiner*—Benjamin H. Layno

[57] ABSTRACT

A card game using a standard fifty two card deck of four suits, is played by dealing a plurality of cards to each player and finally a single face up card (called the "E" card) to the dealer. The object of the game is for the players to have at least one card which is of a higher (or lower, as decided by each player before any cards are dealt) rank than the "E" card and of the same suit. The game is adapted to various forms of wagering, with players being allowed to place sequential bets as each round of cards is dealt to the players. Checks, calls, and raises are also permitted. The total amount bet is split between winning players, in private games. Variations on the number of cards dealt to each player will change the odds for winning payoffs, with fewer cards in a hand providing fewer possibilities for winning, and thus higher payoffs. Another casino variation is an increased payoff for a "straight flush" hand, in which the hand contains a higher (or lower, as earlier decided by the player) sequence of cards of the same suit as the "E" card. The game is very quickly learned and easy to play, thus providing novice and experienced players alike with an equal opportunity to win, yet not requiring novice players to undertake the time consuming task of learning a relatively complex set of rules.

20 Claims, 2 Drawing Sheets

METHOD OF PLAYING A CARD GAME

FIELD OF THE INVENTION

The present invention relates generally to card games, and more specifically to a card game adapted to private and casino gambling and wagering, which game is dependent upon the relative value(s) of at least one of the players'cards in comparison to a single card turned up by the dealer. Additional payoffs may be provided in casino play for straight flush winning hands.

BACKGROUND OF THE INVENTION

Wagers and bets of various kinds have been made at least since the beginning of recorded history, and numerous games and associated equipment (e. g., cards, dice, etc.) have been developed over the years to accommodate such interests. A considerable percentage of the adult population enjoys playing various gambling and wagering games, from informal games in the home to more formal, and perhaps higher stake, casino games. Indeed, numerous state governments have recognized this trait, and have developed state lotteries as a form of voluntary taxation of those persons who enjoy playing such games.

Perhaps the most popular general class of non-mechanized game (as opposed to mechanized slot machines) is the card game, in its various forms. A multitude of different games have been developed over the years, with most adapted to the standard fifty two card deck containing four suits of thirteen cards from ace through deuce in each suit. In order to add interest to the game, as well as requiring some judgment skills on the part of the players, most such games have developed relatively complex rules of play.

While an experienced player may find such complex games to be more interesting than simpler card games, such complex games can be daunting to the beginning player. Mistakes and poor decisions due to a lack of complete understanding of the rules, can be costly and thus many potential players may tend to avoid such games. This is a shame, because many potential players may find such games to be an enjoyable pastime either informally or in a more formal casino environment if they had the opportunity to learn the complex rules, and casinos which offer such complex card games may find their attendance limited only to more advanced and knowledgeable players, thus limiting new potential customers.

Accordingly, a need will be seen for a card game using a standard fifty two card deck, which game is readily adaptable to wagering and betting in both a private game environment and also for casino games. The game must be relatively easy to learn and simple to play, in order to attract beginning players and to avoid a requirement for long study of rules and/or practice of the game before having a consistent chance of winning. By comparing a single card turned up by the dealer with the cards of each player's hand, the outcome of the game may be quickly and easily determined. Yet, the game also allows higher payoffs in at least a casino environment, by means of provision for increased payoffs for straight flush hands higher (or lower, according to the choice of the player before the hand is dealt) than the turned up dealer card. In any event, the game is exceedingly quick to learn, enjoyable to play for those who like such card games, and fast paced for rapid turnover and good profit margins in the casino environment.

DESCRIPTION OF THE PRIOR ART

U.S. Pat. No. 5,154,429 issued to Richard A. LeVasseur on Oct. 13, 1992 describes a Method Of Playing Multiple Action Blackjack, in which two consecutive dealer hands are dealt using the same face up card. All cards of a player hand are added to determine the total value, which must exceed the dealer hand multiple card count without exceeding a total count of twenty one. The present game considers each card in a player hand separately against a single dealer card, and there is no upper "bust" limit for any card or cards. The only common points between the LeVasseur multiple blackjack game and the present game are the single face up dealer card and the requirement that the players place an ante bet before the deal.

U.S. Pat. No. 5,320,356 issued to Glenn J. Cauda on Jun. 14, 1994 describes a Method Of Playing Fast Action Blackjack, in which an initial round of cards are dealt face up and sequential betting may occur as additional cards are dealt to the dealer and to the players, as desired in accordance with the rules of blackjack or twenty one. The game is more closely related to the LeVasseur game discussed immediately above, than to the present game.

U.S. Pat. No. 5,324,041 issued to Eugene E. Boylan et al. on Jun. 28, 1994 describes a High Card Wagering Game in which each player and the dealer receive only a single card. The relative values of the cards are compared, with the higher card winning. This limits the chances of winning for a player, as opposed to the multiple card player hands permitted in the present game. However, the present game requires winning cards to be of the same suit as the dealer card, whereas Boylan et al. are silent regarding suits.

U.S. Pat. No. 5,407,209 issued to Phillip P. Prerost on Apr. 18, 1995 describes a Card Game generally based upon the game of blackjack or twenty one. Prerost allows players to discard a third card from their hands and to take a replacement card, if desired. Otherwise, rules are substantially the same as those for blackjack or twenty one, and thus the Prerost game is more closely related to the LeVasseur and Cauda games discussed above, than to the present card game.

Finally, U.S. Pat. No. 5,417,430 issued to John G. Breeding on May 23, 1995 describes a Progressive Wagering Method And Game, wherein each player must place their full wager before any cards are dealt, but then has the option of retrieving portions of the bet as cards are dealt, as desired. This is opposite the present game, in which players may place a relatively small ante bet, and continue to place additional bets as desired, according to raise and call procedures. Moreover, Breeding requires that the value of each hand be based upon the combined three cards of each player hand and the two cards of the dealer's hand, whereas the present game provides only a single dealer card against which to compare the card(s) of the player hand(s).

None of the above noted patents, taken either singly or in combination, are seen to disclose the specific arrangement of concepts disclosed by the present invention.

SUMMARY OF THE INVENTION

By the present invention, an improved card game is disclosed.

Accordingly, one of the objects of the present invention is to provide an improved card game which uses a conventional deck of fifty two cards comprising four suits.

Another of the objects of the present invention is to provide an improved card game which is adaptable to wagering in a private game or casino environment.

Yet another of the objects of the present invention is to provide an improved card game in which the numerical value and suit of a single face up dealer card is compared against each of the cards of a player hand, with any one player card of the same suit as the single dealer card and having a higher or lower value (as initially decided by the player before the hand is dealt), providing a winning hand for the player.

Still another of the objects of the present invention is to provide an improved card game in which players place an ante bet, and may optionally place further progressive bets to accept additional cards as desired.

A further object of the present invention is to provide an improved card game in which players may check, call, and raise.

An additional object of the present invention is to provide an improved card game in which an additional payoff may be provided in a casino environment, for straight flush player hands which beat the dealer face up card.

A final object of the present invention is to provide an improved card game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
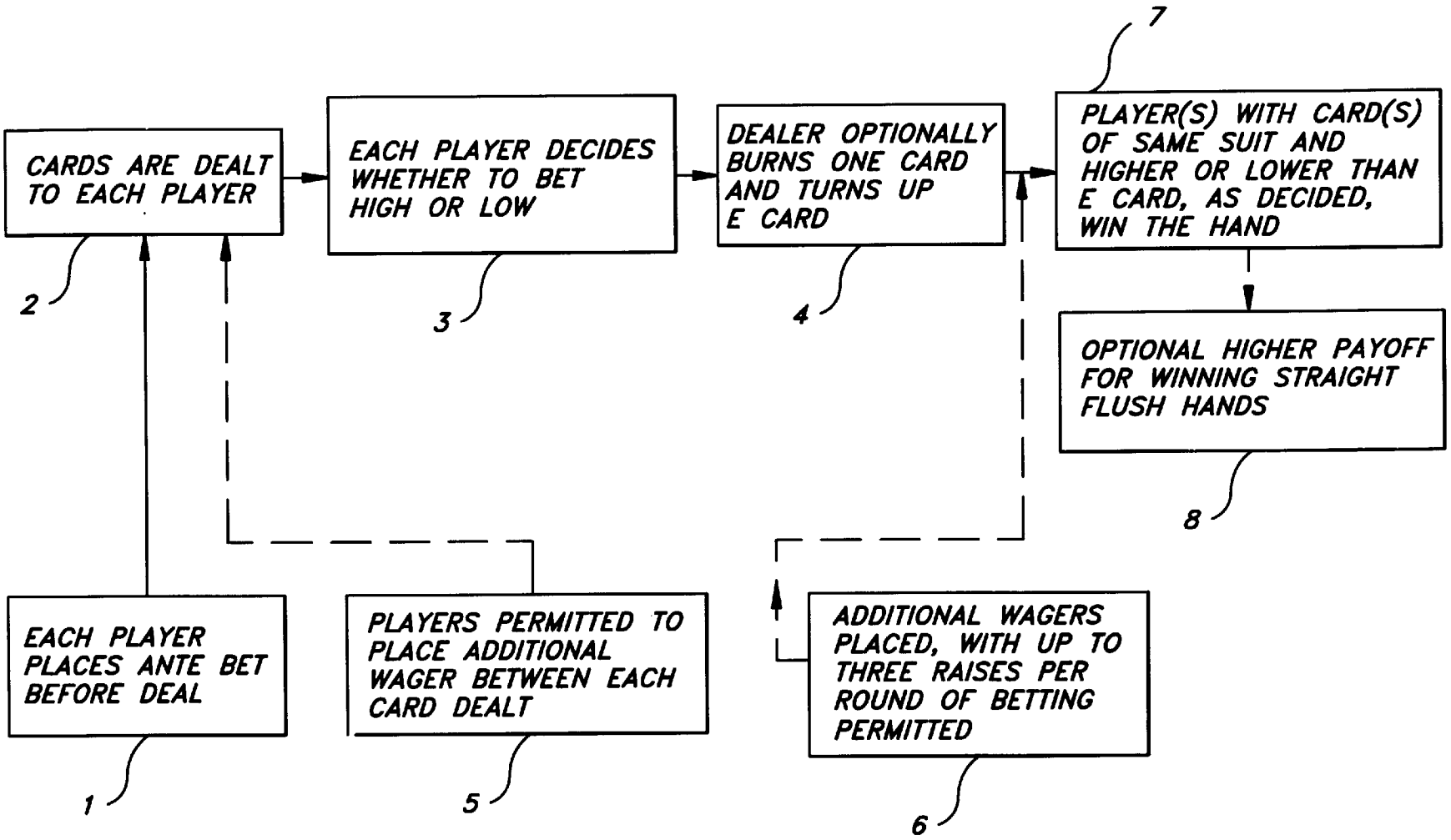
FIG. 1 is a block diagram or flow chart of the general method of play of the present card game.

Referring now particularly to FIG. 1 of the drawings, the present invention will be seen to relate to a method of playing a card game, wherein two or more cards are dealt to each player and a final, single card is then dealt face up. The game uses a conventional so-called "poker" deck of 52 cards of four suits, with each of the suits containing thirteen cards. The object of the game is for each player to have at least one card in his/her hand which is of the same suit as the final face up card (called the "E" card), and which beats the "E" card. While the present game need not require betting or wagering for play, it is well adapted for such wagering, and may be played either as a private stakes game or as a casino game where permitted. Other variations may be included, as described further below.

The game begins with each player placing an "ante" bet before any cards are dealt, as indicated in the first step 1 of FIG. 1, for those games in which betting or wagering is taking place. At this point, each player is required to make a decision as to whether he/she will bet "high" or "low", that is, whether at least one of his/her cards will be numerically higher or lower than the "E" card which will be dealt after the players'hands are dealt; this step is indicated as step 2 of FIG. 1. There is no advantage to either choice; the choice merely allows each player to determine individually whether he/she feels that at least one of the cards in his/her about to be dealt hand, will be either higher or lower than the "E" card, and of the same suit. Thus, if a player plays for a higher card of the same suit, and the only cards he/she receives of the same suit as the "E" card are lower than the "E" card, that player will lose his/her bet. In any case, a player cannot possibly win unless he/she has at least one card of the same suit as the "E" card which is turned up at the end of the deal.

At this point, the dealer (a house dealer and banker in a casino game, or a rotating dealer for each hand, in a private game) deals the cards alternatingly to each player, as indicated generally in step 3 of FIG. 1. Depending upon the variation, anywhere from two to four cards may be dealt, with the dealer optionally "burning" or discarding a card between each round of cards to the players, depending upon the number of cards to be dealt for the hand and the number of players in the game. The dealer may also "burn" a card between the end of the dealing of the hands to the players, and the dealing of the final, face up "E" card, in accordance with step 4 of FIG. 1. In private games, preferably three to four cards are dealt to each player, while in casino type games, a variation may provide only two cards per player. In such a two card hand, the odds of a player receiving a winning higher or lower (as predetermined by the player) card of the same suit as the "E" card are of course less than in the case of a hand containing more cards. Accordingly, a higher payoff (e. g., 2½ to 1) may be provided in such games.

As noted above, the present game is well suited to wagering, and additional wagers may be made by the players as desired as they receive and inspect each card of their hands; this is indicated generally by the optional step 5 of FIG. 1. An additional round of betting may take place after all players receive the last card of their hands, in accordance with optional step 6 of FIG. 1. Players are permitted to raise, check, call, or fold, in accordance with conventional betting procedures. As a raise requires a response from all players (with other players either calling and matching the raise, or folding, if they do not wish to match the raise, thereby eliminating themselves from that particular hand), only three raises may be permitted per each round of betting, in order to streamline the play of the game.

As an example of the betting strategy which may be involved in the present game, let us assume that a player has initially bet that his/her card(s) will be higher than the "E" card. This player is initially dealt a three. In order to win, the "E" card would be limited to a single card in the 52 card deck, i. e., the deuce of the same suit. Thus, the odds would not favor additional betting by this player after the dealing of the first card. The player may wish to fold, losing only his/her ante and eliminating him/herself from that hand, or may wish to call any raises in order to stay in the game as inexpensively as possible. The next card may be a ten, which is more promising, as only four cards (jack, queen, king, and ace) of that suit are higher. If the player has stayed in the game by calling as required, he/she may wish to continue. Wagering may continue in the above manner through the dealing of the entire hand.

It will be seen that a good hand will comprise entirely relatively high cards of different suits, in order to maximize the odds of having a high card of the same suit as the "E" card. Conversely, a hand comprising entirely low cards of different suits would be an excellent hand, if the holder of that hand had bet low, rather than high. It will further be seen that, unlike many other games, the holding of a "flush" or cards of the same suit, is generally not likely to be a winning hand, due to the unlikelihood of the "E" card being of the same suit. (Provision is made for an exception to this rule, further below.) Generally, it is better to have cards in different suits, and as close to the high or low ends of the suits (depending upon the initial decision to go higher or lower than the "E" card) as possible.

When all cards have been dealt for a given hand, and all players have completed any betting for the hand, the dealer optionally burns a card and deals a final card face up, known as the "E" card and described generally in step 4 of FIG. 1. At this point, all players may turn their cards face up, with players having at least one card of the same suit as the "E" card and beating the "E" card, winning the hand, as indicated by step 7 of FIG. 1. It should be noted that a winning card may be either higher or lower than the "E" card, but the player must make that choice before any cards are dealt and he/she sees any cards in his/her hand. Again, a player who has played for a lower card, but who receives only higher cards in the same suit as the "E" card, cannot win the hand. In the event that more than one player has a winning card in his/her hand, the pot in private games is split between players having winning cards. Casino games will pay out without regard to the number of winning players in a given hand.

Another option which may be provided by casino games, is a provision for an additional or higher payoff for "straight flush" winning hands, as provided in the optional step 8 of FIG. 1. This rule requires a player to have a hand containing a numerically consecutive sequence or ranking of cards, all of the same suit, i.e., a "straight flush". (Ace, king, queen, and jack would be considered a consecutive ranking, for example.) In addition, the hand must also extend numerically from the "E" card, either higher or lower, as decided by the player before the dealing of any cards. As an example of the above, let us assume that a player has initially bet upon having at least one card of the same suit and lower than the "E" card and has received the five, six, seven, and eight of spades in his/her hand. The nine of spades is turned up as the "E" card. This would be a winning straight flush hand, as it meets all the criteria: (1) All cards are of the same suit; (2) all cards are in numerically consecutive order; and (3) they form an unbroken numerically consecutive extension of the "E" card, to the direction (in this example, lower) chosen by the player.

It is possible (although unlikely) for there to be two players having such winning straight flush hands, in a single round or hand of play. In the above example, another player may have decided to bet higher than the "E" card, and received the ten, jack, queen, and king of spades. He/she would also have a winning straight flush hand, extending in unbroken consecutive numerical order and sequence from the nine of spades "E" card. This straight flush provision is suited for casino games, in which the "pot" is not limited by the amount bet in a single hand or round of play, due to the much higher odds paid out by the game bank for such straight flush winning hands.

Figure 2:
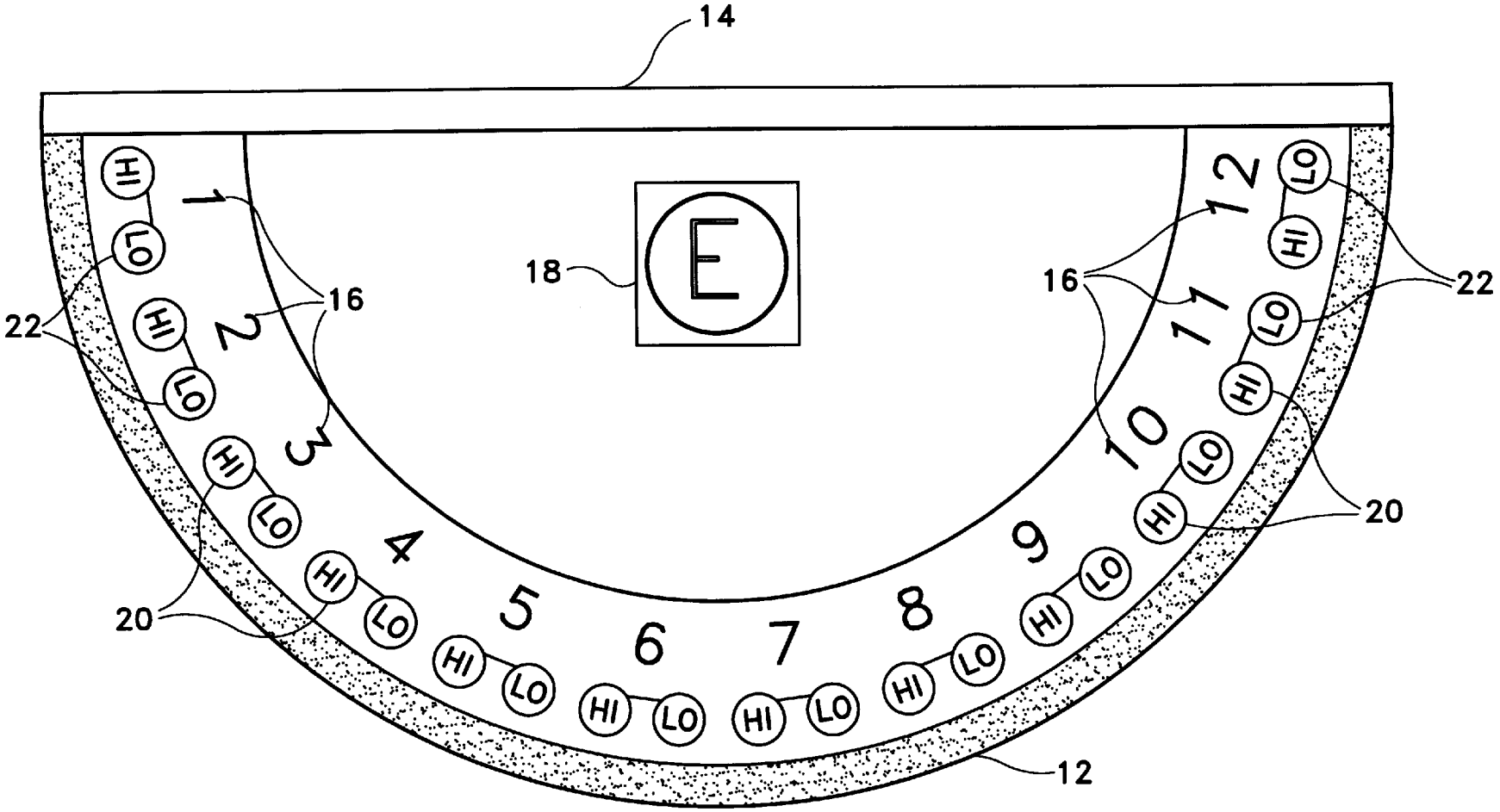
FIG. 2 is a plan view of an exemplary table or playing surface layout for the present game.

As noted above, the present game, particularly in its two card and straight flush four card hand variations, is particularly suited for casino play. FIG. 2 provides a plan view of a game table 10, which is adapted for play of the present game. The table 10 has a generally semicircular player rail 12 and a straight dealer rail or side 14. A plurality of player positions 16 is provided in a semicircumferential arc, immediately inside the player rail 12. Preferably, a total of twelve player positions 16 are provided, enabling four cards to be dealt from a 52 card deck to each of twelve players, with four cards remaining from which to "burn" a card and to finally deal an "E" card face up, in the "E" card position 18. Each of the twelve player positions 16 contains a "HI" (or high) position 20 and a "LO" (or low) position 22, respectively providing for placement of player wagers on either a higher or a lower card of the same suit as the "E" card.

It will be understood that the shape of the table 10, as well as the number and configuration of the player positions 16 and "HI" and "LO" positions 20 and 22, may be modified so long as the basic features providing for play of the present game are retained. For example, the player position numbers may run in increasing order from right to left, rather than from left to right, as indicated, and may have alternative shapes and configurations. The private "poker pot" variation of the present game need not require a specialized table at all, and may be played with players winning only with a card(s) higher than the "E" card, in order to simplify the game and preclude requirement for high and low positions on the table for each player.

In summary, the present card game will be seen to provide a relatively simple and quickly learned game, which is adaptable to either private or casino play. In private play, all wagers are collected in a "pot", with any winning players dividing the pot equally, whereas a casino game provides further opportunities for variations, such as the 2½ to 1 payout for two card winning hands, and higher payouts for straight flush winning hands. Other variations may be played, wherein a player is randomly selected by chance means (dice, cutting cards, etc.) to act as the banker for a hand or game. The banker position may rotate among players during subsequent hands by means of random or sequential selection, if desired. In any of its variations, the present game provides a simple, fast paced, action game which may be enjoyed by players of virtually any level of skill and expertise.

It is to be understood that the present invention is not limited to the sole embodiments described above, but encompasses any and all embodiments within the scope of the following claims.

I claim:

1. A method of playing a card game, comprising the following steps:

(a) providing at least one deck of cards having four suits of thirteen cards in each suit each card in a suit having a different rank;

(b) dealing a plurality of the cards face down alternatingly to each of the players of the game wherein each player is dealt a hand of cards;

(c) permitting each of the players to view each of their cards as they are dealt;

(d) after the hands are dealt and after the players have viewed their cards, turning a final card face up from the deck for all players to view, and;

(e) defining a winning card as a card having the same suit as the final card and having a predefined rank relative to the final card;

(f) comparing the cards of each player hand with the final face up card, with any card of a player hand which is of the same suit as the final face up card and which has said predefined rank relative to the final card, being a winning card for that player.

2. The method of playing a card game according to claim 1, including the step of:

dealing a maximum of four cards to each player.

3. The method of playing a card game according to claim 1, including the step of:

discarding one card after all cards are dealt to all players and before turning up the final face up card.

4. The method of playing a card game according to claim 1, including the steps of:

(a) requiring each player to place a bet before any cards are dealt, and;

(b) providing a payoff to any player having at least one winning card.

5. The method of playing a card game according to claim 4, including the steps of:

(a) permitting each player to bet before any cards are dealt, whether they will have a card of higher rank than and of the same suit as the final face up card, and;

(b) providing a payoff to any player who has bet that they will have a card of higher rank than and of the same suit as the final face up card and having at least one card which is of higher rank than and of the same suit as the final face up card.

6. The method of playing a card game according to claim 4, including the steps of:

(a) permitting each player to bet before any cards are dealt, whether they will have a card of lower rank than and of the same suit as the final face up card, and;

(b) providing a payoff to any player who has bet that they will have a card of lower rank than and of the same suit as the final face up card and having at least one card which is of lower rank than and of the same suit as the final face up card.

7. The method of playing a card game according to claim 4, including the step of:

dividing the total amount bet by all players, between players having winning hands.

8. The method of playing a card game according to claim 4, including the step of:

permitting players to check, call, raise, and fold as desired during the alternating dealing of cards to players.

9. The method of playing a card game according to claim 8, including the step of:

limiting the maximum number of raises to a total of three raises per round of betting.

10. The method of playing a card game according to claim 8, including the step of:

dividing the total amount bet among players who have not folded before the final face up card is dealt, when no player hand contains a winning card.

11. A method of playing a card game, comprising the following steps:

(a) providing at least one deck of cards having four suits of thirteen cards in each suit, each card in a suite having a different rank;

(b) designating a non-player to act as dealer and banker for the game;

(c) requiring each of the players to place an ante bet before any cards are dealt;

(d) dealing a plurality of the cards by the dealer, face down alternatingly to each of the players of the game, wherein each player is dealt a hand of cards;

(e) permitting each of the players to view each of their cards as they are dealt;

(f) after the hands are dealt and after the players have viewed their cards, turning a final card face up from the deck for all players to view;

(g) defining a winning card as a card having the same suit as the final card and having a predefined rank relative to the rank of the final card;

(h) comparing the cards of each player hand with the final face up card, with any card of a player hand which is of the same suit as the final face up card and which has said predefined rank relative to the final card, being a winning card for that player, and;

(I) providing a payoff to any player having a winning card.

12. The method of playing a card game according to claim 11, including the step of:

dealing a maximum of four cards to each player.

13. The method of playing a card game according to claim 12, including the step of:

limiting the maximum number of players to twelve players.

14. The method of playing a card game according to claim 11, including the steps of:

(a) dealing a maximum of two cards to each player, and;

(b) providing a payoff of two and one half to one to any player having a winning card.

15. The method of playing a card game according to claim 11, including the step of:

having the dealer discard one card after all cards are dealt to all players and before turning up the final face up card.

16. The method of playing a card game according to claim 11, including the steps of:

(a) permitting each player to bet before any cards are dealt, whether they will have a card of higher rank than and of the same suit as the final face up card, and;

(b) providing a payoff to any player who has bet that they will have a card of higher rank than and of the same suit as the final face up card and having at least one card which is of higher rank than and of the same suit as the final face up card.

17. The method of playing a card game according to claim 11, including the steps of:

(a) permitting each player to bet before any cards are dealt, whether they will have a card of lower rank than and of the same suit as the final face up card, and;

(b) providing a payoff to any player who has bet that they will have a card of lower rank than and of the same suit as the final face up card and having at least one card which is of lower rank than and of the same suit as the final face up card.

18. The method of playing a card game according to claim 11, including the step of:

permitting players to check, call, raise, and fold as desired during the alternating dealing of cards to players.

19. The method of playing a card game according to claim 18, including the step of:

limiting the maximum number of raises to a total of three raises per round of betting.

20. The method of playing a card game according to claim 11, including the step of:

providing an additional payoff to any player having a consecutive numerical sequence of cards of the same suit as the final face up card and extending from the number of the final face up card.

* * * * *